US006441792B1

(12) United States Patent
Sievenpiper et al.

(10) Patent No.: US 6,441,792 B1
(45) Date of Patent: Aug. 27, 2002

(54) LOW-PROFILE, MULTI-ANTENNA MODULE, AND METHOD OF INTEGRATION INTO A VEHICLE

(75) Inventors: Daniel F. Sievenpiper, Los Angeles; Hui-Pin Hsu, Northridge; James H. Schaffner, Chatsworth; Gregory L. Tangonan, Oxnard, all of CA (US)

(73) Assignee: HRL Laboratories, LLC., Malibu, CA (US)

( * ) Notice: Subject to any disclaimer, the term of this patent is extended or adjusted under 35 U.S.C. 154(b) by 0 days.

(21) Appl. No.: 09/905,757

(22) Filed: Jul. 13, 2001

(51) Int. Cl.[7] ..... H01Q 1/32; H01Q 15/02
(52) U.S. Cl. ..... 343/713; 343/909
(58) Field of Search ..... 343/711, 712, 343/713, 909, 700 MS

(56) References Cited

U.S. PATENT DOCUMENTS

| | | | | |
|---|---|---|---|---|
| 4,308,541 A | | 12/1981 | Seidel et al. | 343/786 |
| 4,737,795 A | * | 4/1988 | Nagy et al. | 343/712 |
| 4,760,402 A | | 7/1988 | Mizuno et al. | 343/713 |
| 4,821,040 A | | 4/1989 | Johnson et al. | 343/700 MS |
| 4,835,541 A | * | 5/1989 | Johnson et al. | 343/713 |
| 5,177,493 A | | 1/1993 | Kawamura | 343/713 |
| 5,402,134 A | * | 3/1995 | Miller et al. | 343/742 |
| 5,532,709 A | * | 7/1996 | Talty | 343/819 |
| 5,541,614 A | | 7/1996 | Lam et al. | 343/792.5 |
| 5,682,168 A | | 10/1997 | James et al. | 343/713 |
| 5,818,394 A | | 10/1998 | Aminzadeh et al. | 343/713 |
| 5,850,198 A | | 12/1998 | Lindenmeier et al. | 343/713 |
| 5,892,485 A | | 4/1999 | Glabe et al. | 343/789 |
| 5,929,819 A | | 7/1999 | Grinberg | 343/754 |
| 6,005,521 A | | 12/1999 | Suguro et al. | 343/700 MS |
| 6,037,912 A | | 3/2000 | DeMarre | 343/815 |
| 6,046,655 A | | 4/2000 | Cipolla | 333/137 |
| 6,081,239 A | | 6/2000 | Sabet et al. | 343/753 |
| 6,091,367 A | | 7/2000 | Kabashima et al. | 343/700 MS |
| 6,118,410 A | * | 9/2000 | Nagy | 343/713 |

FOREIGN PATENT DOCUMENTS

WO 99/50929 10/1999

OTHER PUBLICATIONS

Balanis, C., "Aperture Antennas," *Antenna Theory, Analysis and Design*, 2nd edition, John Wiley & Sons, New York, Chap. 12, pp. 575–597 (1997).

Balanis, C., "Microstrip Antennas," *Antenna Theory, Analysis and Design*, 2nd edition, John Wiley & Sons, New York, Chap. 14, pp. 722–736 (1997).

Perini, P. and C. Holloway, "Angle and Space Diversity Comparisons in Different Mobile Radio Environments," *IEEE Transactions on Antennas and Propagation*, vol. 46, No. 6, pp. 764–775 (Jun 1998).

Vaughan, R., "Spaced Directive Antennas for Mobile Communications by the Fourier Transform Method," *IEEE Transactions on Antennas and Propagation*, vol. 48, No. 7, pp. 1025–1032 (Jul. 2000).

* cited by examiner

*Primary Examiner*—Don Wong
*Assistant Examiner*—Hoang Nguyen
(74) *Attorney, Agent, or Firm*—Ladas & Parry

(57) ABSTRACT

A method of integrating a thin antenna module into a vehicle is disclosed. The thin antenna module comprises a high impedance surface with at least one antenna element disposed thereon. The method includes the steps of inserting the thin antenna module between a conductive layer and a dielectric layer located above a passenger compartment of said vehicle, and connecting at least one antenna element disposed on the high impedance surface to a receiver in said vehicle.

21 Claims, 5 Drawing Sheets

LOW-PROFILE, MULTI-ANTENNA MODULE, AND METHOD OF INTEGRATION INTO A VEHICLE

TECHNICAL FIELD

The present invention relates to broadband antennas for vehicular communication. More specifically, the present invention relates to a broadband multi antenna module and a method of integrating this module into the exterior of a vehicle. The module contains multiple antennas operating in multiple frequency bands, which antennas, when excited appropriately, produce multiple beams and/or receive wireless signals in multiple bands for various wireless services. The present invention allows a single unit to be installed in the vehicle in one operation, which unit can contain all of the antennas necessary for the communication needs of an occupant of the vehicle.

Furthermore, the disclosed antenna module is thin enough to fit between a metallic ground plane that may be part of the vehicle frame. A second surface consisting of dielectric that acts as a radome may also form a part of the module. The module itself preferably combines a ground plane, a feed network, several antennas covering multiple bands and producing multiple beams and preferably also employs techniques for isolating these antennas from their neighbors. This invention reduces or eliminates antenna radiation from entering the interior of the vehicle, while maintaining a thin form factor. Other methods exist for creating low-profile, broadband antennas; however, many of them require removal of a portion of the metallic exterior of the vehicle, thus allowing antenna radiation into the vehicle interior.

BACKGROUND OF THE INVENTION

As demand for existing wireless services grows and new services continue to emerge, there will be an increasing need for antennas on vehicles. Existing antenna technology usually involves monopole or whip antennas that protrude from the surface of the vehicle. These antennas are typically narrow band. Thus, to address a wide variety of communication systems, it is necessary to have numerous such antennas positioned at various locations on the vehicle. Furthermore, as data rates continue to increase, especially with 3G, Bluetooth, direct satellite radio broadcast, and wireless Internet services, the need for antenna diversity will increase. This means that each individual vehicle will require multiple antennas each operating in different frequency bands, and/or with different polarizations and/or at different elevations relative to the horizon. Since vehicle design is often dictated by styling, the presence of numerous protruding antennas will not be easily tolerated. Furthermore, the installation of multiple antennas is costly.

The most basic prior art antenna is the simple whip monopole that is used for FM radio reception and cellular phones. The antenna has a nearly omnidirectional radiation pattern, producing a null only towards the sky. The primary disadvantage of the monopole antenna is that it protrudes from the exterior of the vehicle as an unsightly vertical wire with a height of roughly one quarter wavelength. The monopole is also typically narrowband with a bandwidth of roughly 10%. In order to access multiple wireless services operating on multiple frequencies, multiple monopole antenna would thus be required. Furthermore, if antenna diversity is used to provide directional sensitivity, the number of required antennas is even greater. A logical alternative might be to use a single broadband antenna that could cover all frequency bands of interest. Examples of broadband antennas include spiral antennas, flared notch antennas and log periodic antennas. However, with all of these types of antennas and with broadband antennas in general, the presence of the metallic ground plane is not tolerated. However, if a part of the metal vehicle body is removed and replaced with a dielectric, such a broadband antenna could be integrated into this dielectric and would function over a broad bandwidth. This concept is shown in FIG. 1. A significant drawback of this approach is that it allows the interior of the vehicle to receive just as much antenna radiation as the exterior. With increasing questions over the effects of electromagnetic radiation, this design may be undesirable.

Antennas exist which can function well in the presence of the metallic ground plane, such as patch antennas and various types of traveling wave antennas. These antenna all tend to excite surface currents in a surrounding ground plane. Such surface currents can tend to cause interaction between the individual antennas and can also cause radiation to occur at discontinuities or at edges of the ground plane. This problem is shown in FIG. 2.

Thin antennas exist, such as patch antennas; however, they typically exhibit a narrow bandwidth and do not provide flexibility in the shape of the radiation pattern and/or their sensitivity pattern. Conversely, broadband antennas exist, but they generally are not thin and/or they cannot tolerate the presence of a nearby metal ground plane. One possible solution is to eliminate the metallic ground plane by removing a portion of the vehicle frame or body and replacing it with a sheet of dielectric. A thin broadband antenna can then be mounted on the dielectric sheet to provide access to many wireless services. The problem with this solution is that the elimination of the ground plane allows radiation inside the vehicle interior. Furthermore, with many services sharing the same antenna, interference between devices within the vehicle is increased.

The prior art includes the following:

1) D. Sievenpiper and E. Yablonovitch, "Circuit and Method for Eliminating Surface Currents on Metals" U. S. provisional patent application, Ser. No. 60/079,953, filed on Mar. 30, 1998 by UCLA and corresponding PCT application PCT/US99/06884, published as WO99/50929 on Oct. 7, 1999, the disclosures of which are hereby incorporated herein by reference.These applications disclose a Hi-Z surface.
2) U.S. Pat. No. 4,821,040 entitled "Circular Microstrip Vehicular RF Antenna", assigned to Ball Corporation of Muncie, Ind. This patent describes an antenna consisting of a circular slot radiator that may be mounted within the roof of a vehicle.
3) U.S. Pat. No. 6,091,367 entitled "Light-weight Flat Antenna Device Tolerant of Temperature Variation", by Kabashima, Shigenori; Ozaki, Tsuyoshi; Takahashi, Toru; Konishi, Yoshihiko; and Ohtsuka, Masataka. This patent describes an array of multiple conventional patch antennas.
4) U.S. Pat. No. 6,037,912 entitled "Low Profile Bi-Directional Antenna", by DeMarre, Allen G. This patent describes a low-profile antenna system for mounting on the exterior of a vehicle.
5) U.S. Pat. No. 5,850,198 entitled "Flat Antenna with Low Overall Height", by Lindenmeier, Heinz; Hopf, Jochen; and Reiter, Leopold. This patent describes an antenna for accessing multiple frequency bands for multiple RF services by providing multiple resonant regions that act as separate antennas.
6) U.S. Pat. No. 5,818,394 entitled "Flat antenna", by Aminzadeh, Mehran; Burkert, Manfred; Daginnus, Michael; and Chen, Shun-Ping. This patent describes an antenna mounted below the windshield of a vehicle, resulting in a low-profile design which is hidden from view.

7) U.S. Pat. No. 5,682,168 entitled "Hidden Vehicle Antennas", by James, Jesse C.; and Blackmon, Jr., James B. This patent describes a way of mounting antennas in motor vehicles.

8) U.S. Pat. No. 5,177,493 entitled "Antenna Device For Movable Body", by Kawamura, Katsuaki. This patent describes a method of mounting an antenna on a vehicle.

9) U.S. Pat. No. 4,760,402 entitled "Antenna System Incorporated in the Air Spoiler of an Automobile", by Mizuno, Hiroshi; Sakurai, Takashi ; and Shibata, Yoshihisa. This patent describes a way of hiding an antenna in the air spoiler of a vehicle.

Still there is a need for a single antenna unit that combines antennas for various services, and can be installed in a vehicle simply, preferably in one operation. This antenna unit should be thin and should contain a ground plane that can be integrated with or made to cooperate with the metal exterior of the vehicle so as to avoid vehicle interior radiation. Furthermore, this antenna unit should allow access to multiple wireless services which means it should operate in multiple frequency bands. For the reasons described above, it should contain several separate antennas with each antenna operating at a single band. These individual antennas should be isolated from one another and should also not allow radiation to leak into the interior of the vehicle, such as through surface currents. In order to cooperate to vehicle styling considerations, this antenna unit should also be covered by a smooth surface that can be painted to match the color of the vehicle on which it is installed. To enable low-cost installation, it should have a single connector that supplies DC power and provides an RF interface to each antenna.

Related art includes the following patent applications which are assigned to assignee of the present invention:

1) D. F. Sievenpiper, J. H. Schaffner, "A Textured Surface Having High Electromagnetic Impedance in Multiple Frequency Bands", U.S. patent application Ser. No. 09/713,119 filed Nov. 14, 2000, the disclosure of which is hereby incorporated herein by reference. A Hi-Z surface with multiple band capability is disclosed by this US Patent Application.

2) D. F. Sievenpiper; J. H. Schaffner; H. P. Shu; G. Tangonan, "A Method of Providing Increased Low-Angle Radiation in an Antenna" U.S. patent application Ser. No. 09/905,796 filed on the same date as this application the disclosure of which is hereby incorporated herein by reference. A crossed slot antenna able to receive vertically and circularly polarized RF signals is disclosed by this application.

3) D. F. Sievenpiper; J. Pilulski; J. H. Schaffner; T. Y. Hsu "Molded High Impedance Surface and A Method of Making Same" U.S. patent application Ser. No. 09/905,794 filed on the same date as this application the disclosure of which is hereby incorporated herein by reference. An inexpensive and flexible Hi-Z surface is disclosed by this application.

4) D. Sievenpiper, H. P. Hsu, G. Tangonan, "Planar Antenna with Switched Beam Diversity for Interference Reduction in Mobile Environment", U.S. patent application Ser. No. 09/525,831 filed Mar. 15, 2000, the disclosure of which is hereby incorporated herein by reference.

5) D. Sievenpiper; A. Schmitz; J. Schaffner; G. Tangonan; T. Y. Hsu; R. Y. Loo; R. S. Miles, "A Low-Cost HDMI-D Packaging Technique for Integrating an Efficient Reconfigurable Antenna Array with RF MEMS Switches and a High Impedance Surface" U.S. patent application Ser. No. 09/906,035 filed on the same date as this application the disclosure of which is hereby incorporated herein by reference.

BRIEF DESCRIPTION OF THE INVENTION

In one aspect, the present invention provides a method of integrating a thin antenna module into a vehicle, the thin antenna module comprising a high impedance surface with at least one antenna element disposed thereon, the antenna having a thickness which is less than one tenth of a wavelength of the frequencies which the antenna is responsive. The method comprises the steps of inserting the thin antenna module between a conductive layer and a dielectric layer located above a passenger compartment of the vehicle, and connecting at least one antenna element disposed on the high impedance surface to a receiver in the vehicle.

In another aspect, the present invention provides an antenna which may be conveniently mounted in a vehicle, the antenna comprising: (a) a ground plane formed by a structural portion of the vehicle; (b) a high impedance surface mounted on the ground plane formed by a structural portion of the vehicle, and (c) at least one antenna element disposed on the high impedance surface. The high impedance surface comprises (1) at least one layer of a dielectric material; (2) a plurality of conductive elements arranged in an array and disposed adjacent one surface of the at least one layer of a dielectric material; and (3) a ground plane layer disposed adjacent another surface of the at least one layer of a dielectric material. The least one antenna element is disposed on the high impedance surface adjacent the plurality of conductive elements arranged in an array, the antenna element having at least one major axis which is parallel to the array when the at least one antenna element is disposed on the high impedance surface adjacent the plurality of conductive elements.

In yet another aspect, the present invention provides an antenna for mounting in a vehicle, the antenna comprising: a sheet of dielectric material forming a portion of the vehicle; a ground plane sheet disposed adjacent a headliner in the vehicle, the headliner being disposed in the vehicle in a confronting relationship with the sheet of dielectric material; and a high impedance surface which comprises: (1) at least one layer of a dielectric material; (2) a plurality of conductive elements arranged in an array and disposed adjacent one surface of the at least one layer of dielectric material; and (3) a ground plane layer disposed adjacent another surface of the at least one layer of dielectric material. The antenna further comprises at least one antenna element disposed on the high impedance surface adjacent the plurality of conductive elements. The high impedance surface is disposed between the ground plane sheet and the sheet of dielectric material such that the plurality of conductive elements of the high impedance surface and the at least one antenna element disposed thereon confront the sheet of dielectric material forming a portion of the vehicle.

In yet another aspect, the present invention provides an antenna for mounting on a vehicle, the antenna comprising: a high impedance surface adapted to be mounted on a ground plane formed by a structural portion of the vehicle, the high impedance surface comprising: (1) at least one layer of a dielectric material; (2) a plurality of conductive elements arranged in an array and disposed adjacent one surface of the at least one layer of a dielectric material; and (3) a ground plane layer disposed adjacent another surface of the at least one layer of a dielectric material. At least one antenna element is disposed on the high impedance surface adjacent the plurality of conductive elements arranged in an array, the antenna element having at least one major axis which is parallel to the array when the at least one antenna element is disposed on the high impedance surface adjacent the plurality of conductive elements. A connector is provided for coupling a source of DC to active components associated with the antenna and for coupling RF from the antenna.

The present invention provides a new way of integrating antennas into vehicles which solves several problems that exist with current vehicular antennas. The primary problem with current vehicle antennas is that they typically extend a large distance from the surface the vehicle, resulting in an unsightly protrusion that is unacceptable given current vehicle styling trends. One technique that has been proposed to avoid this problem is to replace a portion of the vehicle's exterior, such as the roof, with an area of dielectric. This eliminates the presence of a metallic ground plane and allows an antenna to lie within the plane of the vehicle exterior and to not protrude from the surface. The problem with this solution is that the removal of the metallic ground plane allows antenna radiation to reach into the vehicle. The present invention allows the metallic ground plane to be retained and instead to uses low-profile antennas which are preferably covered by a dielectric radome or color surface. The use of small low-profile antennas permits several radiating apertures to share the same ground plane. The separate apertures are then separated using a passivation material, which may be either a Hi-Z surface or a lossy material.

DETAILED DESCRIPTION OF THE PREFERRED EMBODIMENTS

Figure 1:
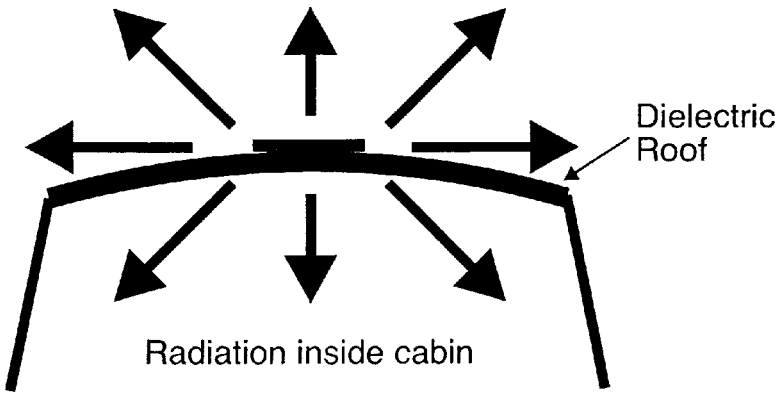
Figure 1 Prior Art
FIG. 1 depicts, as an elevation view through the cabin portion of a vehicle, one possible way of providing a vehicle, such as an automobile, with an antenna which conforms to the shape of the roof of the vehicle.
Figure 2:
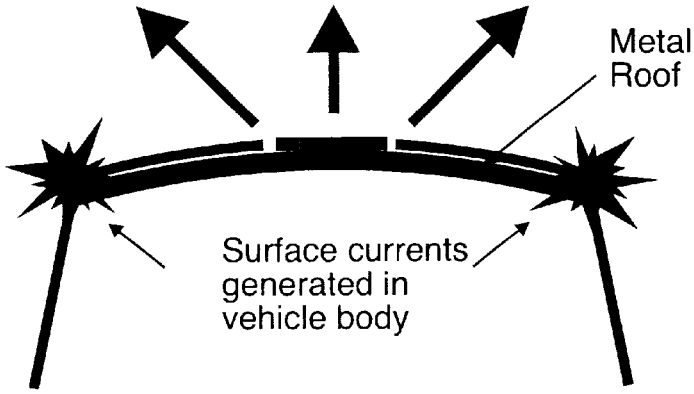
Prior Art Figure 2
FIG. 2 depicts, as an elevation view through the cabin portion of a vehicle, another possible way of providing a vehicle, such as an automobile, with an antenna which conforms to the shape of the roof of the vehicle.

A solution to the problem of making an antenna conform to the shape of the vehicle, yet radiate away from the vehicle interior and the occupants 1 thereof without unduly exciting surface currents in the surrounding ground plane, is shown in FIGS. 3–6. In this embodiment of the present invention, the conventional roof of the vehicle 10 is replaced with a three layer structure. The lowest structural layer is a metal ground plane and would typically be formed as a portion 12 of the frame of the vehicle. The next layer is a single multi antenna module 24 that is an important feature of this invention. The module 24 includes its own that metal ground plane 16 (see FIG. 6) which provides an electrical connection to the metal surface 12 of the vehicle to increase the effective size of the ground plane. It also includes a number of antennas 18 operating in various frequency bands and producing various radiation patterns 20 that are specific to the bands of interest. For example, for the PCs (Personal Communication System) Band, which is a terrestrial system, the desired radiation/sensitivity pattern should be greatest near or at the horizon and should exhibit vertical polarization. For the SDARS (Satellite Digital Audio Radio System) Band, which includes both a satellite system and a terrestrial system, the radiation/sensitivity pattern should have two aspects: (i) it should have good radiation/sensitivity characteristics in the direction of the sky where satellites can occur and, in this aspect, it should exhibit circular polarization, and (ii) it also should to have good radiation/sensitivity characteristics towards the horizon with vertical polarization. See U.S. patent application Ser. No. 09/905,996 filed Jul. 13, 2001 entitled "A Method of Providing Increased Low-Angle Radiation in an Antenna". Each of these functions can be served by one, two, or several antennas, depending on the degree of antenna diversity desired. Increasing antenna diversity tends to improve antenna directionality and thus tends to improve the rejection of unwanted signals.

To minimize the complexity of filters required in the radio receivers, it is desirable to limit the interaction between each of these antennas. For this reason it is preferred that the antennas be separated by a passivation material 22. This passivation material 22 is preferably a Hi-Z surface although a lossy material might also prove to be satisfactory in some embodiments. A lossy material is one in which the imaginary part of the dielectric permitivity is significant in relation to the real part thereof (i.e. the imaginary part of the dielectric permitivity is equal to or greater than the real part thereof). This is often expressed by the 'loss tangent' which is equal to the ratio of the imaginary part to the real part of the dielectric permitivity. A material can also have magnetic loss, and will then have a magnetic loss tangent. This magnetic tangent is equal to the ratio of the imaginary part to the real part of the magnetic permeability. A lossy material has a loss tangent and/or a magnetic loss tangent greater than 0 and typically on the order of 1. A Hi-Z surface is a thin multi-layered structure which typically has a ground plane and another surface comprising an array of small patches which are disposed much less than one wavelength from the ground plane. Hi-Z surfaces are disclosed, for example, by PCT application PCT/US99/06884, published as WO 99/50929 on Oct. 7, 1999.

The use of a Hi-Z surface as the passivation material 22 provides a reactive termination to the surface currents which is desirable for antenna efficiency. The use of a lossy material between the antennas can also limit their interaction, however, this use of a lossy material reduces the overall efficiency of the antennas compared to using a Hi-Z surface and therefore the use of a lossy material as compared to the use of a Hi-Z surface for the passivation material 22 is believed to be a less desirable alternative. While a lossy material can prevent the propagation of surface currents by absorbing them, a reactive surface (such as the Hi-Z surface) prevents their propagation by providing a reactive termination to the currents. The Hi-Z surface is engineered so that the resonance frequency of the Hi-Z surface is equal to or nearly equal to the frequency of operation of the antennas. This may mean that the impedance of the Hi-Z surface is not uniform, but rather varies to suit the immediately adjacent antenna. The resonance frequency is equal to the inverse square root of the product of the built in capacitance and inductance. The capacitance is determined by the product of the overlap area between adjacent plates and the dielectric constant of the material between them. The inductance is determined by the thickness of the Hi-Z surface multiplied by the magnetic permeability of the material that makes up the supporting circuit board.

Figure 7:
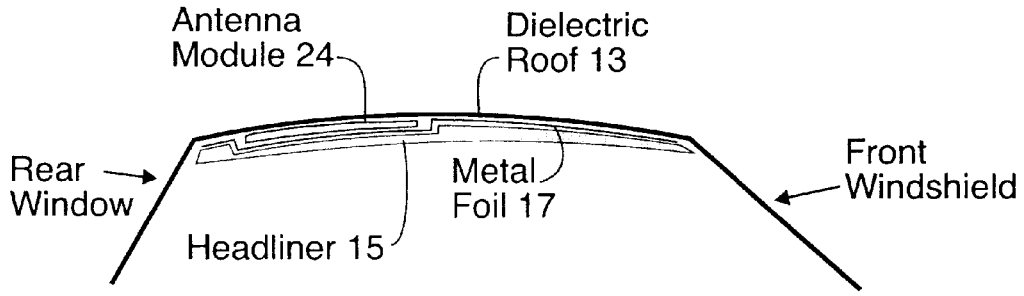
FIG. 7 depicts an antenna module disposed between a headline and a dielectric roof of a vehicle.

The antenna module 24 is thin enough to fit between a metallic ground plane 12 that may be part of the vehicle frame (such as a roof member) and a second surface 26 consisting of dielectric that acts as a radome (see, for example, FIGS. 3 and 8) or between a dielectric surface 13 that may be part of the vehicle frame and a metal lined headliner 15, 17 (see, for example, FIG. 7). The module 24 itself combines a ground plane 16, a feed network, several antennas 18 covering multiple bands and producing multiple beams, and passivation material 22 which isolates these antennas conveniently from their neighbors. The feed network typically consists of several parts: (1) a connector 28, which preferably contains both the RF lines and DC power supply for active electronics associated with the individual antennas, (2) a transmission line or group of transmission lines 19, 21 which route the RF signals to and from the antennas and at least some of which also carry the DC power, (3) an antenna switch 26, and (4) some antennas may also require RF filters or low-noise amplifiers to eliminate signals from unwanted bands form reaching an antenna. A filter is likely also to be provided within the receiver, which receiver will be located somewhere else within the vehicle. The feed network includes the RF switch 26 and the transmission lines 19, 21 and allows multiple receivers, for example, to be switched from among several antennas 18 mounted in the module 24.

Each time that an object such as an antenna or a receiver must be installed into a vehicle, the vehicle manufacturer tends to incur significant assembly and manufacturing costs. For this reason all of the antennas required by the vehicle for communication needs should preferably be integrated into this a single unit or module and preferably should be accessed to by a single connector 28 which provides both a DC power interface and an RF interface to each of the antennas associated with the unit or module. The unit or module may also contain a microprocessor as part of smart antenna switch 26 which would provide, for example, switched beam diversity by selecting among the various antenna elements dedicated to each band. DC power is used to power the switches and the microprocessor used in the unit or module and is preferably supplied via transmission line 21.

Figure 3:
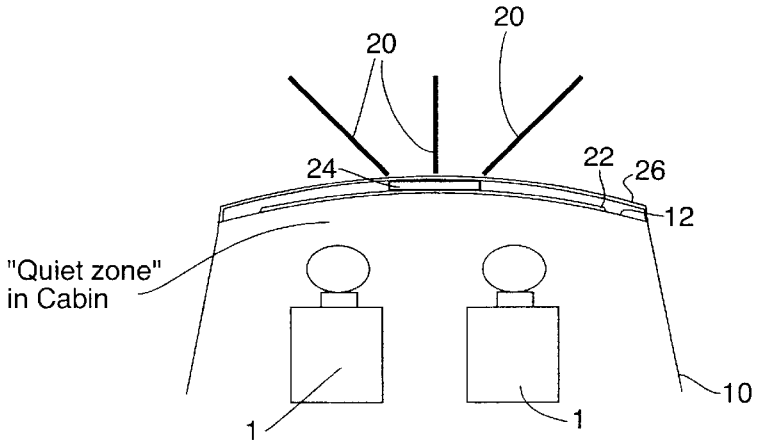
FIG. 3 depicts, as an elevation view through the cabin portion of a vehicle, an embodiment of an antenna which conforms to the shape of the roof of the vehicle without unduly radiating the interior of the vehicle and without unduly exciting surface currents in the surrounding ground plane.
Figure 4:
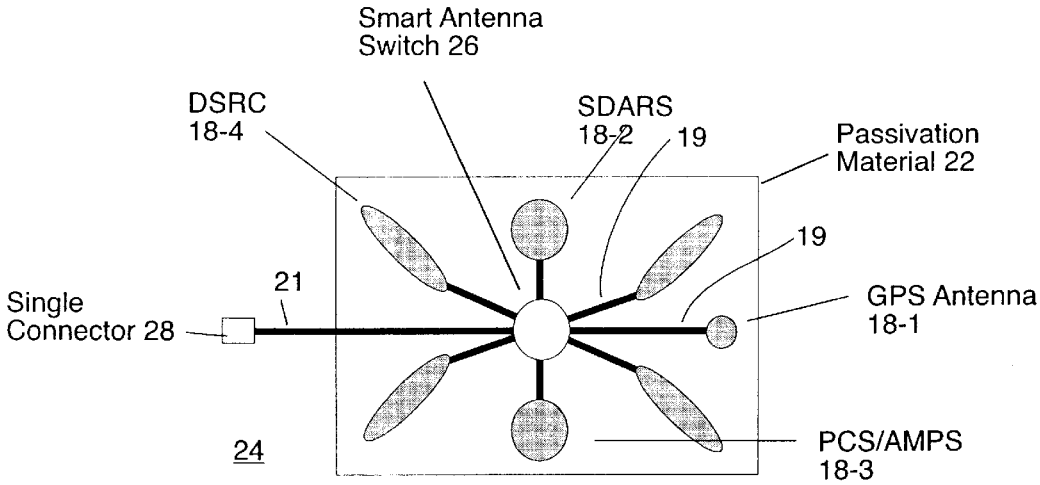
FIG. 4 is a plan view of the antenna depicted in FIG. 3.

This version of the antenna module 24 is shown in FIG. 4. The module 24 includes ground plane 16 (see FIG. 6*a*), an arrangement of antennas 18-1–18-4 covering multiple frequency bands and producing multiple radiation patterns, and a passivation material 22 separating the antennas one from another, which material may be reactive and/or resistive. If multiple beams 20 (see FIG. 3) are used for one or more of the bands noted above for spatial diversity, then the modular antenna 24 of this invention preferably also includes an antenna switch 26 with a diversity microprocessor which causes the antenna switch to switch between the various antenna elements 18 for diversity control. The microprocessor selects among the antennas having various radiation patterns to maximize the received signal to noise or signal to interference ratio.

The wireless services this antenna might provide include: Advanced Mobile Phone System (AMPS), Personal Communications System (PCs), Global Positioning System (GPS), Direct Short-range Communications (DSRC), and/or Satellite Digital Audio Radio System (SDARS). As such, the antennas shown in FIG. 4 are apt to work in different frequency ranges or bands. The Hi-Z surface should be engineered such that it exhibits a phase which falls in the range of $-\pi/2$ to $+\pi/2$. for each frequency band of interest and with a phase shift of zero at the center of the frequency band of interest. FIG. 4 shows four different antennas 18-1–18-4 and assuming that those antennas operate in four different frequency bands, the Hi-Z surface should have a zero phase shift in the center of each of those frequency bands at least in the vicinity the associated antenna. This can be obtained (1) by adjusting the built in capacitance and inductance of the Hi-Z surface 22 such that in the regions thereof immediately adjacent each antenna exhibit a zero phase shift in the center of the frequency band associated with the antenna in question or (2) by providing the Hi-Z surface 22 with multiple band capability as is disclosed by U.S. patent application Ser. No. 09/713,119 filed Nov. 14, 2000 and entitled "A Textured Surface having High Electromagnetic Impedance in Multiple Frequency Bands."

The passivation material 22 also isolates the antennas from their surrounding electromagnetic environment and shields the interior of the vehicle from the effects of electromagnetic radiation emanating from the antennas. The modular antenna of the present invention further preferably includes a single connector 28 that provides both DC power and RF access to the antennas in the module.

Figure 8:
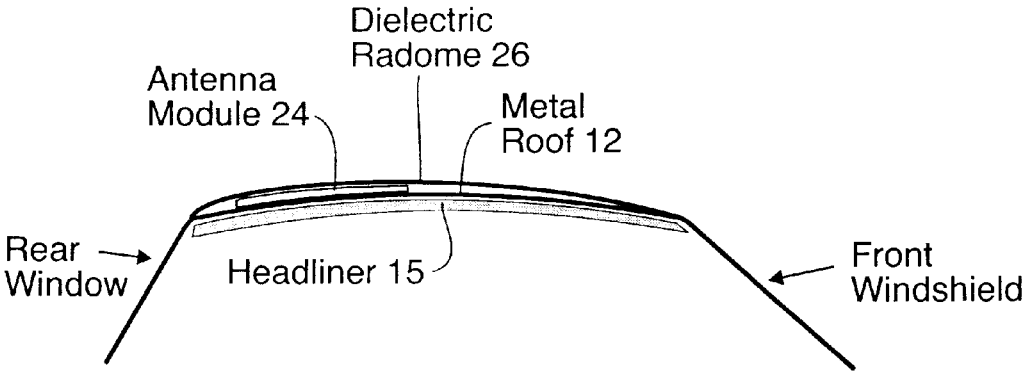
FIG. 8 depicts an antenna module disposed on a metal roof of a vehicle.

The present invention also provides a technique for integrating the disclosed antenna module into a vehicle. In the embodiments of FIGS. 3 and 8, at least a three layer structure results in which the lowest structural layer is the metal skin 12 of the vehicle, the outer layer is a dielectric radome 26 which protects the underlying module 24 and provides a smooth, paintable surface with a middle layer comprising the multi antenna module 24 disclosed herein. In the embodiment of FIG. 7, at least a three layer structure also results in which the ground plane 17 is provided by a non-structural element such a metal foil 17 associated with headliner 15, for example, and the dielectric member is preferably a structural member of the vehicle, such as its roof 13, with the module sandwiched therebetween.

Figure 5:
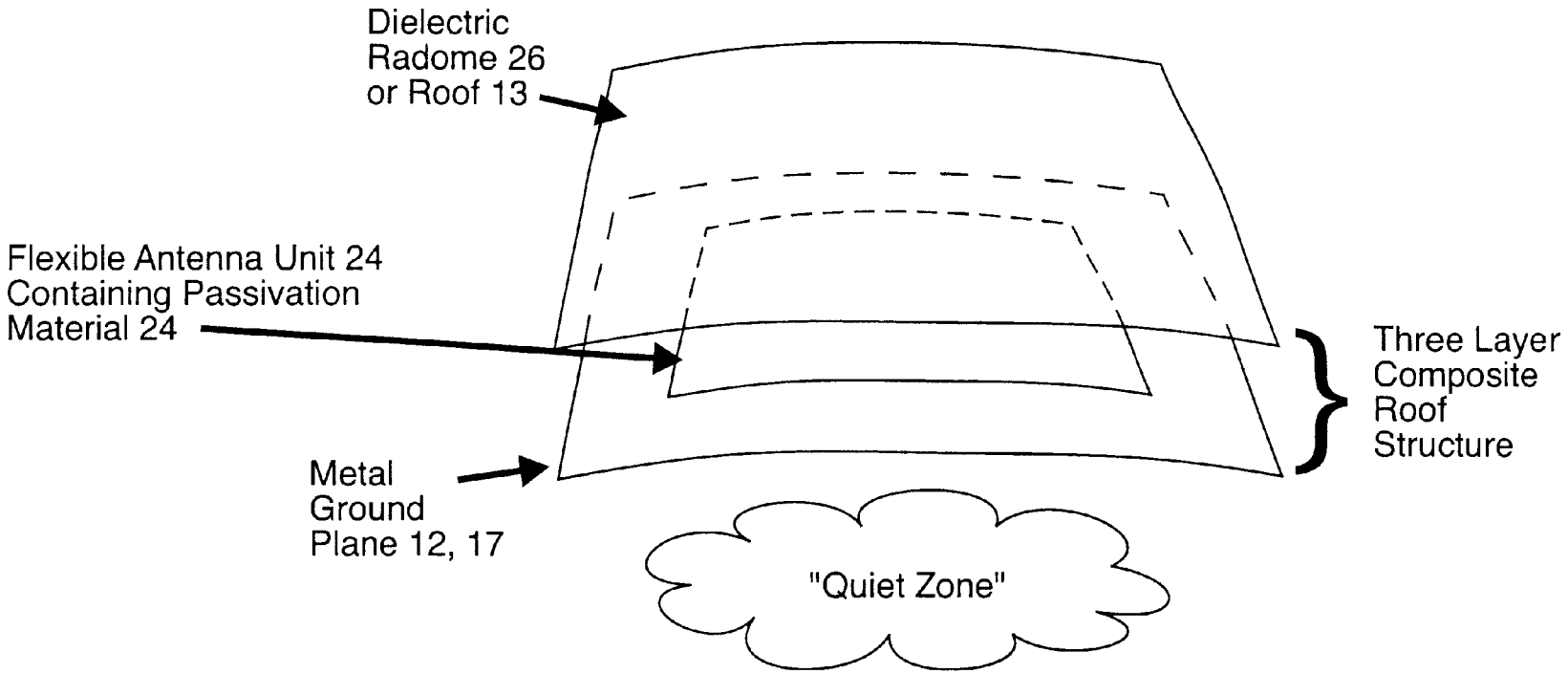
FIG. 5 is an exploded perspective view of the antenna module depicted by FIGS. 3 and 4.
Figure 6A:
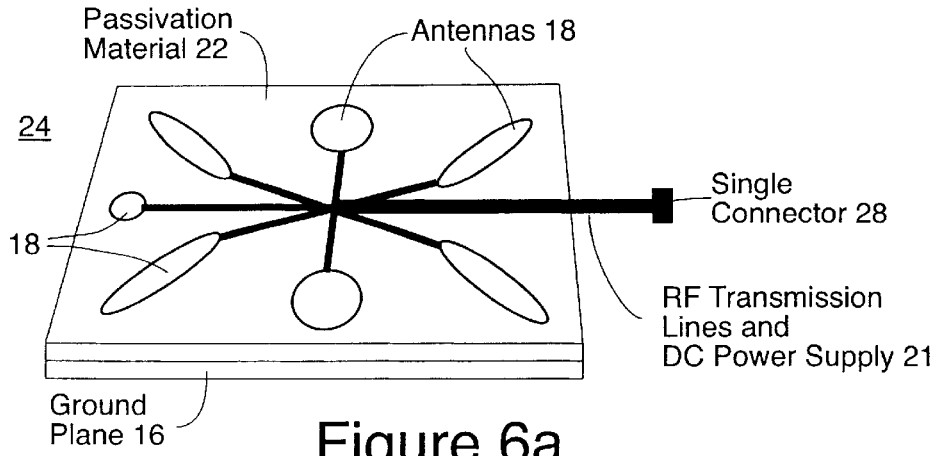
FIG. 6*a* is a perspective view of the antenna module of FIGS. 3–5.
Figure 6B:
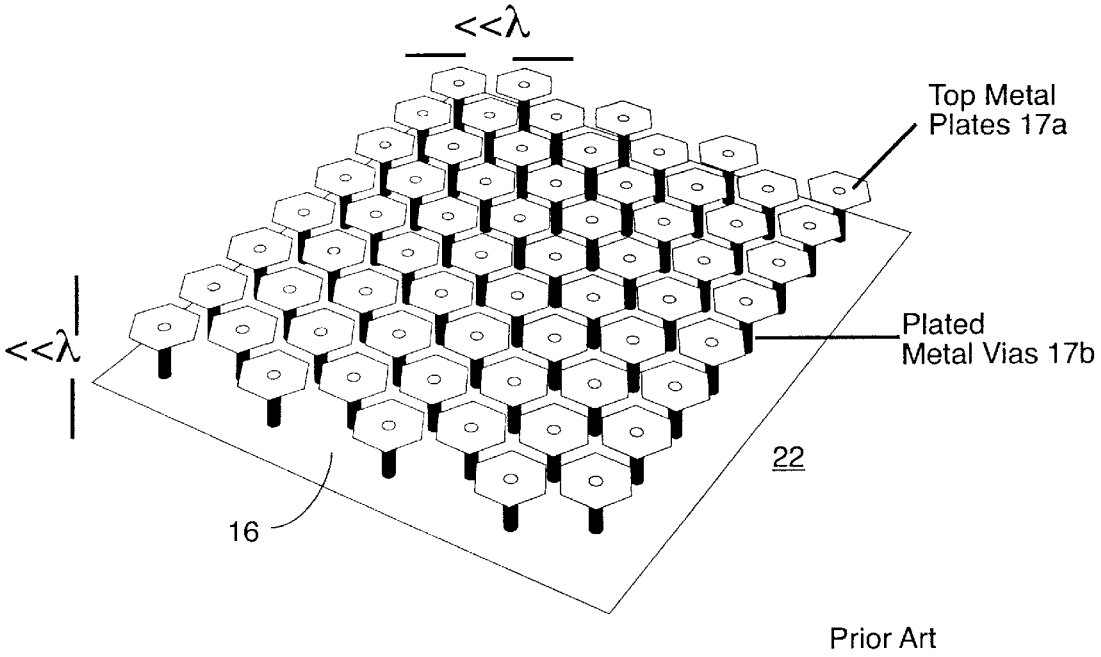
FIG. 6*b* is a perspective view of a Hi-Z surface.

The three layer structure is shown conceptually by FIG. 5 which depicts an exploded perspective view of the integrated antenna module 24 sandwiched between a ground plane 12, 17 and a dielectric surface 13, 26. A perspective view of the module 24 is shown by FIG. 6*a*. A conventional Hi-Z surface is shown in FIG. 6*b*. The Hi-Z surface includes ground plane 16, a plurality of conductive metal plates 17*a* spaced a small distance (much less than a wavelength for the frequency of interest) from the ground plane 16 and metal conductive vias 17*b* coupling the metal plates 17*a* to the ground plane 16. Conventional Hi-Z surfaces are typically made using printed circuit board technology and thus exhibit a certain amount of flexibility depending on the thickness of the components used. Even more flexible Hi-Z surfaces are disclosed in copending U.S. patent application Ser. No. 09/906,035 filed Jul. 13, 2001 entitled "A Low-Cost HDMI-D Packaging Technique for Integrating an Efficient Reconfigurable Antenna Array with RF MEMS Switches and a High Impedance Surface" and in copending U.S. patent application Ser. No. 09/905,794 filed Jul. 13, 2001 entitled "Molded High Impedance Surface and A Method of Making Same" the disclosures of each of which are hereby incorporated herein by reference. Thus the module can be easily deformed, if necessary, to conform to the surface of the roof of the vehicle.

In the embodiment of FIGS. 3 and 8 the vehicle has a metallic structural body which may be used as the ground plane 12 and the antenna module 24 is fixed thereto and then covered by a dielectric radome 26. The radome 26 is preferably a thin unitary structure made of a suitable dielectric material such as acrylonitrile-butadiene-styrene (ABS) which covers all of the antennas provided in the antenna module. In this embodiment, the antenna module 24 is preferably mounted on or to a structural element 12 of the vehicle and preferably to the roof structural element thereof over the passenger compartment.

There are other ways that the antenna module 24 can be integrated with a vehicle. In the embodiment of FIG. 7 the structural, exterior member 13 of the roof is made of a strong dielectric material such as polycarbonate which can serve as the radome and preferably can be painted to match the rest of the vehicle's exterior. In this case, to provide the metal ground plane, the antennas are preferably attached to a metal-coated headliner 15 and/or to a metal foil 17 which may be simply constrained in place by or attached to the headliner 15. The metal coating can be a thin, flexible metal such as a aluminum foil, or more preferably, a flexible plastic-metal composite. The headliner 15 of a vehicle is usually a separate part which is installed in the factory through the front or rear window. It can be wholly or partially removed for servicing the components between it and the roof of the vehicle. In this embodiment, the antenna module preferably comprises the ground plane 16, the passivation material 22, the array of various antennas 18, the connector 28, and the cable 21. The antenna module may be adhered to the interior of the metal frame with adhesives or with snap connectors, both of which are commonly used in the production of automobiles, or with other attachment means such as screws, straps, rivets, bolts, and the like or a combination of the foregoing. Preferably, the attachment means should allow the module to be removed, if needed, yet provide adequate adherence so that the module does not become undone when the vehicle becomes involved in a traffic accident.

If the structural member of the roof is metal, then the antenna module 24 is preferably installed on an outer surface 12 of the metal roof of the vehicle and fixed thereto by suitable attachment means such as an adhesives, snap connectors, screws, straps, rivets, bolts, and the like or by combination of the foregoing. A dielectric cover 26 is then preferably installed from the outside of the vehicle, over the antenna module 24, so as to give the vehicle a smooth, aerodynamic exterior. The dielectric cover is preferably fixed in place using suitable attachment means. Alternatively, the dielectric cover may form a part of the antenna unit itself and thus be installed at the same time the antenna unit 24 is installed on the vehicle.

The preferred location for the antenna module 24 is above a passenger compartment of a vehicle. However, it can be located on any convenient surface of the vehicle. For example, if the vehicle is an airplane or airship, then the antenna module could be located below a passenger, freight or engine compartment of such a vehicle.

Having described the invention in connection with certain preferred embodiments thereof, modification will now certainly suggest itself to those skilled in the art. The invention is not to be limited to the disclosed embodiments, except as is specifically required by the appended claims.

What is claimed:

1. A method of integrating a thin antenna module into a vehicle, the thin antenna module comprising a high impedance surface with at least one antenna element disposed thereon, the method comprising the steps of:

inserting the thin antenna module between a conductive layer and a dielectric layer located adjacent a compartment of said vehicle, and connecting at least one antenna element disposed on the high impedance surface to a receiver in said vehicle.

2. The method of claim 1 wherein the conductive layer is a portion of a structural part of the vehicle.

3. The method of claim 2 wherein the structural part forms at least a portion of a roof of said vehicle.

4. The method of claim 2 wherein the structural part forms a metal roof of said vehicle.

5. The method of claim 1 wherein the conductive layer is a non-structural part of the vehicle.

6. The method of claim 5 wherein the non-structural part is a thin conductive layer attached or secured in place by a headliner in said vehicle.

7. The method of claim 6 wherein the thin conductive layer is a metal foil material.

8. The method of claim 1 wherein the dielectric layer is a portion of a structural part of the vehicle.

9. The method of claim 8 wherein the structural part forms at least a portion of a roof of said vehicle.

10. The method of claim 8 wherein the structural part forms a metal roof of said vehicle.

11. The method of claim 1 wherein the dielectric layer is a portion of a non-structural part of the vehicle.

12. The method of claim 11 wherein the non-structural part is a thin dielectric layer attached or secured in place over said antenna module on an exterior surface of said vehicle.

13. A antenna mounted on a vehicle, said antenna comprising:

(a) a ground plane formed by a structural portion of said vehicle;

(b) a high impedance surface mounted on said ground plane formed by a structural portion of said vehicle, said high impedance surface comprising:

(1) at least one layer of a dielectric material;

(2) a plurality of conductive elements arranged in an array and disposed adjacent one surface of said at least one layer of a dielectric material; and (3) a ground plane layer disposed adjacent another surface of said at least one layer of a dielectric material; and (c) at least one antenna element disposed on said high impedance surface adjacent said plurality of conductive elements arranged in an array, said antenna element having at least one major axis which is parallel to said array when said at least one antenna element is disposed on said high impedance surface adjacent said plurality of conductive elements.

14. The antenna of claim 13 wherein the high impedance surface and the at least one antenna are packaged as a module which is installed as a unit on said ground plane formed by a structural portion of said vehicle.

15. An antenna mounted on a vehicle, said antenna comprising:

(a) a sheet of dielectric material forming a portion of said vehicle;

(b) a ground plane sheet disposed adjacent a headliner in said vehicle, said headliner being disposed in said vehicle in a confronting relationship with the sheet of dielectric material;

(c) a high impedance surface comprising:

(1) at least one layer of a dielectric material;

(2) a plurality of conductive elements arranged in an array and disposed adjacent one surface of said at least one layer of dielectric material; and (3) a ground plane layer disposed adjacent another surface of said at least one layer of dielectric material;

(d) at least one antenna element disposed on said high impedance surface adjacent said plurality of conductive elements; and (e) wherein said high impedance surface is disposed between said ground plane sheet and said sheet of dielectric material such that said plurality of conductive elements of said high impedance surface and said at least one antenna element disposed thereon confront said sheet of dielectric material forming a portion of said vehicle.

16. The antenna of claim 15 wherein the high impedance surface and the at least one antenna are packaged as a module which is installed as a unit between said ground plane sheet and said sheet of dielectric material.

17. An antenna for mounting on a vehicle, said antenna comprising:

(a) a high impedance surface adapted to be mounted adjacent a ground plane formed by a structural portion of said vehicle, said high impedance surface comprising:

(1) at least one layer of a dielectric material;

(2) a plurality of conductive elements arranged in an array and disposed adjacent one surface of said at least one layer of a dielectric material; and (3) a ground plane layer disposed adjacent another surface of said at least one layer of a dielectric material;

(b) at least one antenna element disposed on said high impedance surface adjacent said plurality of conductive elements arranged in an array, said antenna element having at least one major axis which is parallel to said array when said at least one antenna element is disposed on said high impedance surface adjacent said plurality of conductive elements; and (c) a connector for coupling RF from said antenna.

18. The antenna of claim 17 further includes active component and wherein the connector couples a source of DC to said active components.

19. The antenna of claim 17 wherein the high impedance surface and the at least one antenna are packaged as a module which is adapted to be installed as a unit on a ground plane formed by a structural portion of the vehicle such that the ground plane layer of the high impedance surface cooperates with the ground plane formed by the structural portion of the vehicle.

20. The antenna of claim 17 wherein the high impedance surface and the at least one antenna are packaged as an antenna module which is adapted to be installed as a unit adjacent a structural portion of said vehicle.

21. The antenna of claim 20 wherein the antenna module is adapted to be installed as a unit adjacent a structural portion of said vehicle with the ground plane layer of the high impedance surface cooperating with a ground plane formed by or adjacent the structural portion of the vehicle.

* * * * *